United States Patent [19]

Laursen

[11] 4,059,240

[45] Nov. 22, 1977

[54] THREAD STORAGE AND SUPPLY DEVICE

[75] Inventor: Ove Laursen, Dalum, Sweden

[73] Assignee: AB IRO, Ulricehamn, Sweden

[21] Appl. No.: 722,963

[22] Filed: Sept. 13, 1976

[30] Foreign Application Priority Data

Sept. 12, 1975 Germany ..... 2540746

[51] Int. Cl.[2] ..... B65H 51/20

[52] U.S. Cl. ..... 242/47.01

[58] Field of Search ..... 242/47.01, 47.12, 47.13; 66/132 R, 132 T; 139/452

[56] References Cited

U.S. PATENT DOCUMENTS

| | | | |
|---|---|---|---|
| 3,782,661 | 1/1974 | Deniega | 242/47.01 |
| 3,796,386 | 3/1974 | Tannert | 242/47.12 |
| 3,994,446 | 11/1976 | Jacobsson | 242/47.01 |

*Primary Examiner*—Edward J. McCarthy
*Attorney, Agent, or Firm*—Blanchard, Flynn, Thiel, Boutell & Tanis

[57] ABSTRACT

A thread storage and supply device, particularly for a textile machine, having first storage means for a positive thread supply and a second storage means located ahead of the first storage means for permitting an intermittent thread supply. The second storage means includes an elongated hollow shaft having a stationary storage drum mounted thereon. The first thread storage includes a thread drum disposed adjacent and coaxial with the storage drum and rotatably supported on an extension of the hollow shaft. A winding element is associated with the storage drum for permitting winding of a thread thereon, which winding element is rotatably supported on the hollow shaft and disposed axially between the storage and thread drums. The thread withdrawn from the storage drum passes axially through the hollow shaft and is then wound onto the annular thread storage area of the thread drum. A drive device includes a driving element shiftable between two positions, the first being wherein the driving element engages solely the thread drum for rotating same. The driving element, when in the second position, simultaneously engages both the thread drum and the winding element so that they rotate at the same speed.

11 Claims, 1 Drawing Figure

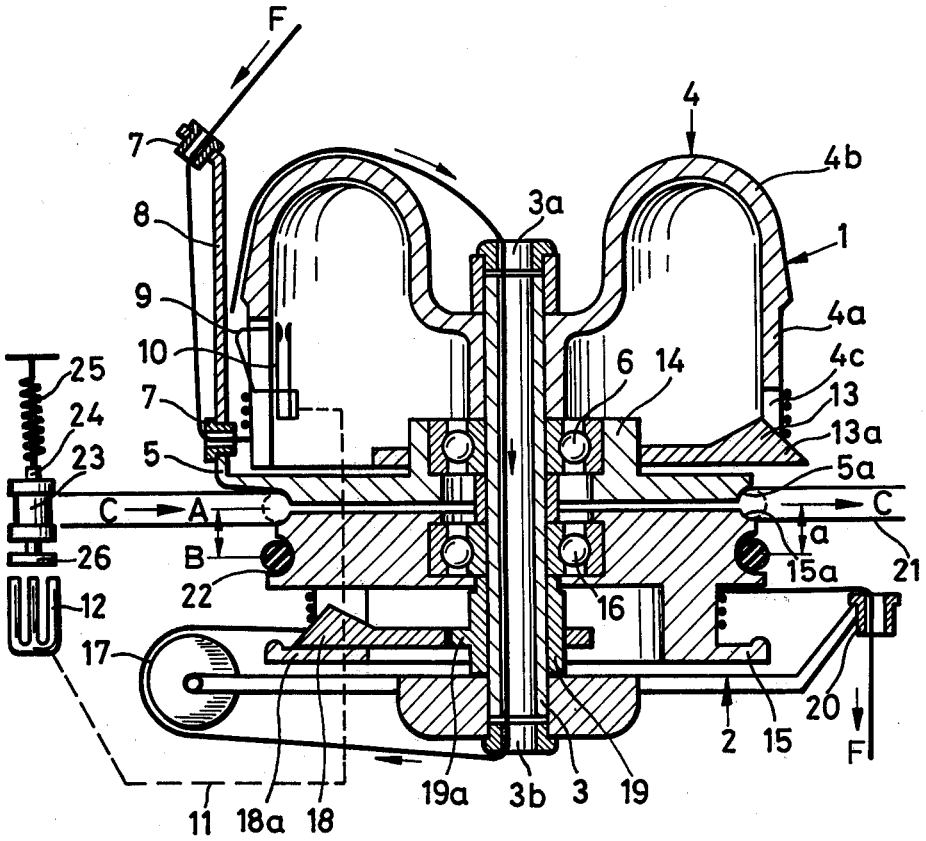
F
7
8
9
10
7
5
25
24
23
26
12
17
C
A
B
22
11
18a
18
19a
3b
3
19
2
15
20
F
16
15a
a
C
21
5a
13a
13
4c
4a
1
4b
4
3a
6
14

THREAD STORAGE AND SUPPLY DEVICE

BACKGROUND OF THE INVENTION

This invention relates to a thread storage and supply device, preferably for textile machines, having a storage for positive thread supply preceded by a storage for intermittent thread supply.

Such an arrangement is selected to achieve especially low and regular output tension on the thread from the positive storage. It has hitherto been common in practice to let the known intermittent storage means operate together with a separate positive storage, e.g. a band storage. This solution is wasteful in terms of the space required.

The object of the invention is to provide a device of the type cited at the outset which is very simple and space-saving in construction.

This invention provides a thread storage and supply device in which a storage for intermittent thread supply and a storage for positive thread supply are combined. Both storages are known per se (East German patent specification No. 83,007 and German Auslegeschrift No. 2,160,161). In this invention, only a single shaft is required, and the space required is thus small. The path of the thread from the intermittently operating storage to the positive storage is very short and is accommodated in the hollow shaft in a space-saving and reliable manner. The device in accordance with the invention can, of course, be employed for purely intermittent thread supply if the thread is conducted from the hollow shaft directly to the processing station without having to pass through the positive storage. Likewise, the positive storage can be utilized alone if the thread is supplied directly to the hollow shaft from the storage bobbin without passing over the intermittent storage drum. It is possible to switch these three different modes of operation in a very simple and rapid manner. The present invention, however, is concerned only with the integrated device in its entirety and not with each individual storage respectively.

In a preferred embodiment, a common drive means is provided for the positive thread drum and for the winding element of the intermittent storage drum, said drive means being switchable in response to the stored amount of thread such that it drives only the positive thread drum when a predetermined maximum amount on the intermittent storage drum has been reached, whereas it also drives the winding element when the intermittent thread storage falls below a predetermined minimum amount. The result is a simple structure since, in addition to a single drive means, certain switching and control elements are required only once.

The external diameter of the intermittent storage drum, at least in the winding area, can advantageously be greater than that of the positive thread drum in the winding area. This makes it possible to drive the positive thread drum and the winding element of the intermittent storage drum at the same angular speed so that the forces which occur as well as the rotating elements cannot influence one another. Due to the synchronous operation of the positive thread drum and of the winding element, one respective winding is applied both to the positive thread drum as well as to the intermittent storage drum in the same period of time, in which time, however, less than one winding is removed from the intermittent storage drum due to the circumferential difference therebetween. Hence, the amount of the circumferential difference determines the rate at which a thread storage is formed or supplemented on the intermittent storage drum.

In a preferred embodiment, the opposed areas of the positive thread drum and the winding element are closely adjacent and have the same external diameter so as to share a common driving surface for a common driving element. The space required is especially small in this case. The construction costs are reduced still further, since the costs of auxiliary devices such as control elements and the like are lower for a single driving element.

In a preferred embodiment, the drive means includes an endless drive belt and the adjacent areas of the winding element and the positive thread drum have as the driving surface annular notches which supplement one another to form a groove corresponding to the belt cross section, and the positive thread drum has another annular groove corresponding to the belt cross section in axially spaced relation to the area adjacent said winding element. If the drive belt engages the groove common to the winding element and the thread drum, it drives both elements. If the drive belt is inserted into the groove belonging only to the positive thread drum, it acts as a drive means only for the thread drum and the winding element remains stationary. Hence, in order to switch over, it is not necessary to selectively drive two different drive elements, but rather a single adjustable driving element, which is driven continuously as long as thread is required, is sufficient for the double function.

The switch-over is possible in a simple manner in that the drive means is associated with at least one guide roller for the drive belt which is displaceably disposed at a distance corresponding to the spacing of the grooves, and that the drive means comprises an accumulator which engages in one direction as well as an electromagnet which upon excitation engages in the opposite direction and which can be energized and de-energized in response to the amount of thread on the intermittent storage drum. The height adjustment of the drive belt and thus the inclusion and exclusion of the intermittently operating yarn storage winding element thus necessitates only low construction costs and requires only elements which are simple in operation but nevertheless robust. The electromagnet can be switched reliably by a conventional monitor on the intermittent storage drum. The entire drive means can be arranged easily and in a space-saving manner in the area of the device.

BRIEF DESCRIPTION OF THE DRAWING

One embodiment of the invention is illustrated in the single FIGURE of the drawing.

DETAILED DESCRIPTION

The drawing shows a thread storage and supply device comprising a storage for intermittent thread supply designated in its entirety by 1 and further comprising a storage for positive thread supply designated in its entirety by 2. Both are disposed on a common shaft 3 which is hollow and designed as a thread channel.

The intermittently operating storage 1 has a storage drum 4 which is nonrotatably mounted on the stationary shaft 3. The drum 4 is associated with a winding element 5 which is mounted on the shaft 3 by means of a rolling bearing 6. This bearing is surrounded by the thread supply area **4*a* of the storage drum, which area is remote from the free end of said shaft 3. The winding element 5 supports, outside the circumferential area of the storage drum 4, two thread eyes 7 which are disposed in spaced relation from one another on an arm 8 which is approximately parallel to the drum axis. The marginal area 4***b* of the storage drum which faces away from the winding element 5 extends beyond the end 3*a* of the shaft 3 and is designed as a curved thread guide surface. A sensing element 9 is located on the wall of the storage drum 4 and cooperates with a switch 10 dependent on the number of thread windings in the area 4*a*. The switch 10 is coupled via a line 11 with an electromagnet 12 outside the storage drum. Moreover, the storage drum 4 has nonrotatably associated therewith an element 13 for pushing forward (upwardly in the drawing) the thread windings. Element 13 is in the form of a movable finger 13 which executes a reciprocating radial movement relative to the shaft 3. The finger 13 has an inclined ramp surface 13*a* which passes through a slot 4*c* in the thread supply area 4*a* of the storage drum. The other end of the finger 13 is supported about an eccentric hub 14 which surrounds the rolling bearing 6.

The positive thread storage 2 has a thread drum 15 which is mounted so as to be rotatable about the shaft 3 by means of bearing 16. A wheel 17 for reversing the direction of the thread issuing at the end 3*b* of the shaft 3 is secured to the shaft 3. A thread advancing element 18 is positioned on the thread drum 15 and rotates together with said drum. The thread advancing element 18 is designed as a finger which can be reciprocated radially relative to the shaft and which has an outer inclined thread ramp surface 18*a*. The inner portion of the finger 18 is supported on the shaft 3 so as to be rotatable about a hub 19 having an eccentric portion 19*a*.

The thread supply area of the thread drum 15 lies opposite the end 3*b* of the shaft 3, while the thread removal area lies facing the storage drum 4. A cylindrical portion having a peripherial area intended for engagement with a driving element 21 extends between this thread removal area, which has associated therewith a thread removal eye 20 at the same level, and the winding element 5. In their adjacent areas, the winding element 5 and the thread drum 15 have the same external diameter and each has an annular notch 5*a* or 15*a* respectively. The notches 5*a* and 15*a* have a cross section approximating a quarter circle such that they supplement each other to form a semicircle which is intended to receive therein a driving element. The thread drum 15 has another groove 22 with a semicircular cross section in spaced relation from its notch 15*a*. The distance from the imaginary center of the groove 22 to the imaginary center of the groove formed by the notches 15*a* and 5*a* corresponds to a distance *a*. The wall of the thread drum 15 between both grooves has a convex curvature.

The driving element 21 consists of an endless drive belt with a circular cross section. It is illustrated in two different positions in the drawing which it can assume selectively. The change of position is indicated by the double arrow A-B. The arrows C show the direction in which the drive belt runs. It issues from a driving device (not shown), passes over a guide roller 23 which is supported on a shaft 24 so as to be loosely rotatable. The shaft 24 is secured at one end to a tension spring 25. The free end of the shaft 24 lies opposite the electromagnet 12 and supports a magnetic plate 26.

OPERATION

The thread storage and supply device described above operates as follows:

The guide roller 23 is located in the illustrated position and is maintained there by the spring 25. The drive belt 21 thus passes through the groove formed by the notches 5*a* and 15*a*, thereby driving the winding element 5 and the thread drum 15 simultaneously in a direction corresponding to a clockwise direction when looking down upon the storage drum. The thread F issues from a thread bobbin or the like, passes through the thread eye 7 and is wound on to the stationary storage drum 4 by the rotating winding element 5. Due to the rotation of the winding element 5 with the eccentric hub 14, the finger 13 is caused to radially reciprocate at the same time. The inclined ramp surface 13*a* thereof slides the thread windings upwardly in the direction of the free end of the storage drum 4. Here the thread is removed over the rounded marginal area 4*b* and is drawn through the hollow shaft 3. After it emerges from the shaft end 3*b* it passes over the reversing wheel 17, is then supplied tangentially to the thread drum 15 and is wound up due to the rotation thereof. The windings of the thread on the thread drum 15 are slid upwardly on the thread drum 15 by the radially reciprocating finger 18 and by its inclined ramp surface 18*a*. From here the thread is tangentially supplied to the removal eye 20 and from here to a processing station. The winding element 5 and the thread drum 15 rotate at the same angular speed. However, since the diameter of the storage drum 4 and the thread drum 15 differ greatly at least in the winding area, with the storage drum 4 having the larger diameter, an ever greater thread storage is collected on the storage drum 15, with the number of windings on the thread drum 15 always remaining the same. As soon as the thread storage on the storage drum 4, which is checked by means of the sensing element 9, has exceeded a predetermined size, the sensing element 9 actuates the switch 10 and this excites the electromagnet 12 which pulls the shaft 24 via the plate 26 downwardly against the force of the spring 25, thereby shifting the guide roller 23 and with it the drive belt 21 from position A to position B. The drive belt 21 then falls into the groove 22 of the thread drum 15 and continues to drive it at the same speed and sense of direction as indicated above. The winding element 5, however, now remains stationary. The thread drum 15 now continues to withdraw thread from the storage drum 4, thereby reducing the thread storage thereupon. When a predetermined specific minimum amount of thread is reached, the sensing element 9 releases the switch 10, the electromagnet 12 is de-energized and the spring 25 moves the guide roller 23 back into position A. The drive belt 21 thus returns to position A and now again drives the thread drum 15 as well as the winding element 5, whereby the thread storage is again formed on the storage drum 4.

It is also possible to remove the thread from the thread drum 15 not tangentially through an eye disposed radially outside the thread drum, but rather over the top in a downward direction. In this case, however, the thread drum must be provided with an element which prevents the thread from rotating about the removal edge so that the unwinding speed is limited to the winding speed.

It is also possible, of course, to drive the positive storage 2 and the intermittently operating storage 1 separately by a separate driving element respectively as in the case of known storage devices, a coupling being provided in the area of the intermittently operating storage. An entirely separate drive means for each storage is of course possible as well, although very expensive in construction.

In order to transport the thread windings axially, two or more fingers can be used instead of one reciprocating finger. Other means may be used as well, e.g. a known swash (wobble) plate or a conical connecting piece.

Although a particular preferred embodiment of the invention has been disclosed in detail for illustrative purposes, it will be recognized that variations or modifications of the disclosed apparatus, including the rearrangement of parts, lie within the scope of the present invention.

Instead of the storage feeder 2 a known tape feeder, in which the yarn is guided over only a part of the periphery of the feeder drum by a tape driving the drum, can be used for positive feeding of the yarn.

What I claim is:

1. In a thread storage and supply device, preferably for textile machines, having first storage means for positive thread supply preceded by second storage means for intermittent thread supply, comprising the improvement wherein the second storage means has a stationary storage drum provided with a hollow shaft and onto which a thread issuing from a thread supply can be wound by a winding element which can be driven to rotate coaxially of the stationary storage drum in order to form an intermediate thread supply thereon, and from which the thread can be removed from this intermediate thread supply over the end of the stationary storage drum and through the hollow shaft, wherein said first storage means has a thread drum which can be rotatably driven and upon which the thread issuing from the stationary storage drum can be wound tangentially and from which it can be unwound tangentially at an unwinding speed equal to the winding speed, the rotatable thread drum being located on an extension of the hollow shaft, and the stationary storage drum with its thread supply area being located closely adjacent the thread drum.

2. A device according to claim 1, wherein drive means is provided for the rotatable thread drum and for the winding element, said drive means being switchable in response to the amount of stored thread on the stationary storage drum such that said drive means drives only the rotatable thread drum when a predetermined maximum amount of thread on the stationary storage drum has been reached but it also drives the winding element when the thread storage on the stationary storage drum falls below a predetermined minimum amount.

3. A device according to claim 2, wherein the external diameter of the stationary storage drum, at least in the thread winding area, is greater than that of the thread drum in the thread winding area.

4. A device according to claim 3, wherein the opposing area of the thread drum and winding element are closely adjacent, have the same external diameters and define a common driving surface for a common driving element.

5. A device according to claim 3, wherein the drive means includes an endless drive belt and the adjacent areas of the winding element and thread drum have as the driving surface annular notches which supplement one another to form a groove corresponding to the cross section of the belt, and the thread drum has another annular groove corresponding to the belt cross section in axially spaced relation to its area adjacent said winding element.

6. A device according to claim 5, wherein the drive means is associated with at least one guide roller for the drive belt, said guide roller being arranged to be adapted to slide a distance corresponding to the spacing of the grooves, spring means for urging the guide roller in one direction, and electromagnet means which, when energized, urges the guide roller in the opposite direction and which is energized and de-energized in response to the amount of thread on the stationary storage drum.

7. In a thread storage and delivery device having first storage means for intermittent thread supply, said first storage means including a hollow shaft having a stationary storage drum coaxially mounted with respect thereto, and a rotatable winding element for winding thread from a supply source onto a storage area of said storage drum to form an intermediate thread storage thereon, said winding element being supported for rotation coaxially of said shaft and positioned closely adjacent one end of said storage drum, and a second storage means including a rotatable thread drum having a thread supply area thereon on which thread issuing from the storage drum is wound and from which thread is withdrawn for supply to a textile machine, comprising the improvement wherein the thread drum is rotatably supported on said hollow shaft and is positioned coaxial with and closely adjacent said storage drum, said storage and thread drums being axially separated by the winding element which is positioned axially therebetween, first guide means associated with said storage drum for guiding the thread withdrawn from said intermediate thread storage over the other end of said storage drum and into the adjacent end of said hollow shaft, and second guide means associated with said thread drum for guiding the thread which is withdrawn from the other end of said hollow shaft outwardly around the end of said thread drum so that same can be wound onto said thread supply area, the thread supply area of said thread drum having a diameter which is substantially less than the storage area of said storage drum.

8. A device according to claim 7, including driving means for rotating said thread drum and for selectively rotating said winding element, said driving means including a common driving element which can be selectively shifted between a first position wherein it solely rotates said thread drum and a second position wherein it concurrently rotates both said thread drum and said winding element at the same rotational speed.

9. A device according to claim 8, including control means for automatically shifting said driving element between said first and second positions, and sensing means coacting with said storage drum for sensing said intermediate thread storage and for activating or deactivating said control means when said intermediate thread storage reaches preselected maximum and minimum amounts.

10. A device according to claim 9, wherein said storage drum has first means associated therewith for urging the thread windings associated with the intermediate thread storage axially of the storage drum toward said other end thereof, and wherein said thread drum has second means associated therewith for urging the thread windings associated with the thread supply axially of the thread drum toward the winding member, said first and second means respectively including first and second thread-urging members which are cyclically movable responsive to rotation of the winding element and thread drum, respectively.

11. A thread storage and supply device, preferably for textile machines, comprising a feeder for positive thread supply which is preceded by a feeder for intermittent thread supply, characterized in that the feeder for intermittent thread supply is a feeder which is known per se and which has a stationary storage drum provided with a hollow axle and onto which a thread issuing from a thread supply can be wound by means of a winding element which can be driven to rotate coaxially about the storage drum in order to form an intermediate thread supply, and from which the thread can be removed from this intermediate thread supply over the end of the storage drum and through the hollow axle of the storage drum, that said feeder for positive thread supply consists of a thread drum which can be driven in rotation and upon which the thread issuing from the storage drum can be guided tangentially and from which it can issue tangentially at an unwinding speed equal to the winding speed, that the thread drum is located on an extension of the hollow axle of the storage drum and that the storage drum with its thread supply area is opposite the thread drum.

* * * * *